US005367856A

United States Patent [19]

Kirk et al.

[11] Patent Number: 5,367,856

[45] Date of Patent: Nov. 29, 1994

[54] METHOD FOR PROCESSING AN EXPANDABLE FOOD PRODUCT

[75] Inventors: David Kirk, Brooklyn Park; Raymond Tucker, Bloomington; Michael Perry, Plymouth; Steve Reil, Brooklyn Park, all of Minn.; Larry M. Dugan, Boulder, Colo.; Michael Dreher, Boulder, Colo.; Paul H. LeFevre, Golden, Colo.

[73] Assignee: The Pillsbury Company, Minneapolis, Minn.

[21] Appl. No.: 940,109

[22] Filed: Sep. 3, 1992

[51] Int. Cl.[5] ..... B65B 3/10; B65B 69/00

[52] U.S. Cl. ..... 53/420; 53/471; 53/492

[58] Field of Search ..... 53/412, 471, 473, 133.1, 53/133.2, 410, 420, 440, 470, 492

[56] References Cited

U.S. PATENT DOCUMENTS

| | | | |
|---|---|---|---|
| 862,243 | 9/1907 | Waechter . | |
| 1,811,772 | 6/1931 | Willoughby . | |
| 2,110,615 | 8/1938 | Wilcox . | |
| 2,166,619 | 7/1939 | Becker . | |
| 2,270,935 | 1/1942 | Doering . | |
| 2,478,618 | 8/1948 | Armstrong et al. . | |
| 2,696,443 | 12/1954 | Allbright | 53/440 X |
| 2,904,205 | 9/1959 | Callery . | |
| 3,432,027 | 3/1969 | Mueller . | |
| 3,439,827 | 4/1969 | Marland . | |
| 3,724,742 | 4/1973 | Henderson | 53/412 X |
| 3,897,672 | 8/1975 | Scheindel | 53/470 |
| 3,973,719 | 8/1976 | Johnson et al. | 53/420 X |
| 4,045,938 | 9/1977 | Hansen | 53/470 |
| 4,135,347 | 1/1979 | Lowdermilk | 53/412 X |
| 4,381,315 | 4/1983 | Yong et al. . | |
| 4,415,598 | 11/1983 | Chen et al. . | |
| 4,651,497 | 3/1987 | Grimsley | 53/470 X |

*Primary Examiner*—Horace M. Culver
*Attorney, Agent, or Firm*—Fredrikson & Byron

[57] ABSTRACT

The present invention provides a container suitable for pressurized non-flowable consumer goods such as refrigeratable bread doughs and the like. In a first embodiment, the container includes a removable lid, a shell having sidewalls, and a piston plate. The bottom of the container includes an access port therethrough to permit access to the piston plate, which may be urged upwardly to remove product from the container. In a second embodiment, the container includes a removable lid, a shell having sidewalls and a bottom, and a removable liner. The liner may include manually graspable flanges and a stirrup extending beneath the product. The product may be removed from the container by grasping the flanges of the liner and withdrawing the liner and the product through the open top of the shell.

12 Claims, 7 Drawing Sheets

METHOD FOR PROCESSING AN EXPANDABLE FOOD PRODUCT

FIELD OF THE INVENTION

The present invention generally relates to packages for storing and selling consumer goods and has particular utility for storing and selling processed, refrigeratable dough products.

BACKGROUND OF THE INVENTION

Frequently, primary concerns in designing a package for the sale of consumer goods are: (1) the ability of the package to meet the physical requirements for the particular application in question, (2) the ease of use of the package, and (3) the cost of the package as a part of the total cost of the product sold to the consumer. Additionally, due to a variety of market-related factors and legislative initiatives, environmental concerns are becoming increasingly more important in the process of designing packages.

In the refrigerated dough industry, many refrigerated doughs are currently packaged in composite, spirally wound cans such as those taught in U.S. Pat. No. 2,793,126 issued to Fienup, et al. Such spirally wound composite containers have gained wide-spread acceptance in the industry because they meet the physical requirements for containing such products, have gained acceptance among consumers, and are relatively inexpensive to manufacture.

When refrigerated dough products are packaged for sale to the consumer, a suitable portion of dough, e.g., enough dough for a single loaf of bread or a single batch of biscuits or the like, is placed into the container and the dough is "proofed". This proofing process involves heating the dough within the container to cause the dough to rise and flush the air out of the container. In current commercial processes, the proofing is continued until a positive pressure is achieved within the can. The leavening action generally continues in the can until the internal pressure reaches a level of about 15–20 psi during the product's shelf life. Accordingly, the package itself must be able to withstand those internal pressures.

Although a package formed solely of paper products may be able to withstand such pressures, there is a tendency for moisture in the air to condense on the chilled containers when the dough is refrigerated and moisture in the product contacts the inner surface of the container. If the container were made solely of a paper product, it would tend to become damp and lose its structural integrity, possibly leading to structural failure of the package under internal pressure. Accordingly, a suitable moisture barrier generally must be provided about both the exterior and interior surfaces of the package to prevent the paper elements of the container from becoming damp.

Also, in order to reduce the permeability of the walls of the container and to maintain the integrity of the foodstuffs therein, these barrier layers may be formed of materials which are less permeable to oxygen or the like. Thus, current composite, spirally wound cans used in the refrigerated dough industry generally comprise a structural layer formed of a paper material; an outer wrapper formed of a moisture-resistant material, such as metal foil or a plastic, carried about the exterior of the paper layer; and an internal foil or plastic layer lining the interior of the package and contacting the dough.

As the name implies, each layer of such a spirally wound composite can is formed of a sheet material which is helically wound, with the edges of the sheet being attached to an adjacent edge of the same sheet to define a cylinder. In opening such a container, the outer wrapper is removed by spirally unwinding it and separating it from the central paper layer. This outer wrapper also lends some structural strength to the wall of the container; when it is removed, the remaining layers are frequently designed to be unable to contain the internal pressure of the container and the container may rupture. Alternatively, the container may be able to withstand the pressure and a utensil must be pressed against the seam of the container to complete opening by rupturing the wall. This rupture usually results in a sudden, noisy popping sensation.

When a consumer removes the outer wrapper there is no reliable way to determine when, or even if, the container will rupture. The noise associated with rupturing is therefore unpredictable and oftentimes startles the consumer, even though he or she may expect the rupture at some time during removal of the wrapper. Sometimes, the remaining two layers of the container are indeed sufficiently strong to withstand the internal pressure of the container, requiring the consumer to press against the seal between the edges of the paper sheet to rupture the container to access the product.

It can also be relatively difficult to remove the contents of such containers once they have been opened. The layers of the container's walls tend to retain their generally helical, cylindrical configuration even after the wall has been ruptured. Gaining access to the product within this wall and removing it therefrom requires the consumer to work against this bias of the wall. Additionally, the opening between adjacent edges of the sheet materials of the wall is generally helical as well, further hindering easy removal of the product by requiring the consumer to turn the container while acting against the bias of the walls.

One of the primary forces driving current environmental concerns is the impending crisis in landfill space. Consumers have become increasingly more aware of these environmental factors and have begun making purchasing decisions based upon the recyclability of packages and their components. Furthermore, attempts to increase the recycled-material content and recyclable-material content of consumer packages through legislative activity have become increasingly more common.

Although current composite containers are relatively inexpensive and have proven to be adequate for their intended purpose, they generally are not recyclable. In recycling solid wastes, one must commonly segregate the waste based upon composition so that each type of waste will be suitably processed for recycling. For instance, metal, paper and plastics each require distinct processes for recycling and therefore must be separated from one another before solid waste can be recycled. Current composite, spirally wound cans used in the refrigerated dough industry, though, cannot be readily segregated into their component materials. Hence, in most areas of the United States such composite containers cannot be recycled under current recycling processes and they frequently must be disposed of by incineration or deposited in a landfill.

Thus, most composite packaging structures tend to be inherently non-recyclable, at least under current recycling techniques. Recent marketing studies have indicated that consumers find packages which are recyclable more desirable than those which are not recyclable, and are willing to pay a premium price in order to minimize non-recyclable solid waste from packaging or to use packages which have a significant content of recycled materials. Accordingly, a company which is able to offer consumers a product packaged in a recyclable package would have a market advantage over competitors which sold products in non-recyclable containers. Additionally, some legislatures have already begun to pass laws restricting the use of composite containers.

A number of attempts have been made to design substitute packaging for refrigerated dough products. Those designs which have achieved the necessary structural integrity to be used for this application, though, have generally been relatively difficult for the consumers to use or have been prohibitively expensive. Accordingly, it would be desirable to provide a package for refrigerated dough products and the like which has the necessary structural integrity to handle such products, yet is easy for consumers to use, is not unduly expensive and is recyclable or utilizes recycled materials in its construction.

SUMMARY OF THE INVENTION

The present invention provides a package which is suitable for pressurized, non-flowable consumer goods such as refrigerated bread doughs and the like. The package is adapted to permit a consumer to readily remove the contents of the containers by providing simple inserts to assist in such removal. If so desired, all of the components of the container may be readily formed of a recyclable material or materials such that the entire container may be recycled after use, either as a single unit or as separate component parts. The materials used in the container may instead be derived from previously used, recycled materials, such as paper in a composite structure.

In a first embodiment, a container of the invention comprises a removable lid, a piston and a shell having side walls. The shell has a bottom which includes an inwardly extending flange which engages the piston during storage and an access port permitting access to the piston. When a consumer desires to remove the contents of the container, the lid is removed to provide an upper opening and the consumer pushes the piston toward the upper opening, thereby urging the contents of the container out of the opening.

In a second, alternative embodiment, the container includes a shell having side walls and a bottom, a removable lid and a removable liner. The liner desirably comprises one or more liner segments adapted to line the side walls of the shell, a stirrup extending between and effectively connecting the bottoms of the liner segments, and a pair of manually graspable flanges, with one flange being associated with each of the liner segments. To remove the goods from the container of this embodiment. The consumer removes the lid, grasps the flanges of the liner and pulls the liner out of the shell. During this operation, the stirrup at the bottom of the liner ensures that all of the contents of the container are easily removed from the shell along with the liner. The liner may then be opened by moving the liner segments away from one another to permit access to the goods.

DETAILED DESCRIPTION OF THE PREFERRED EMBODIMENTS

Figure 1:
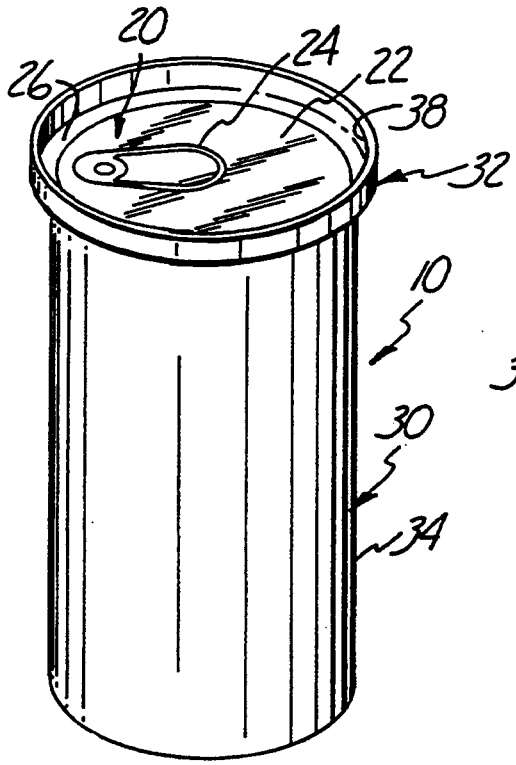
FIG. 1 is a perspective view of a container according to a first embodiment of the present invention.
Figure 2:
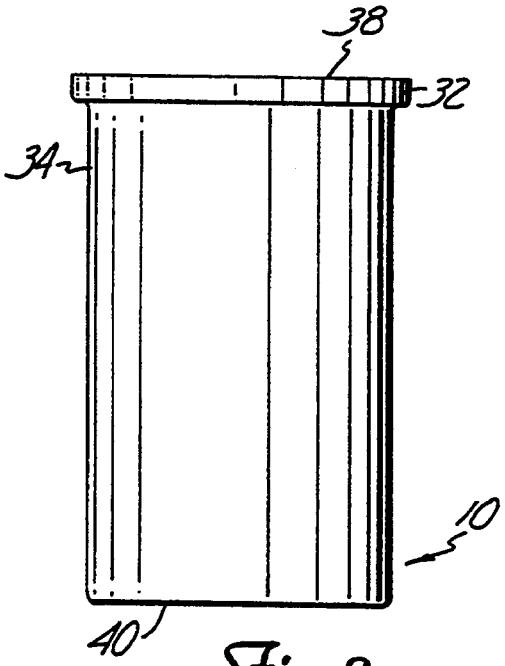
FIG. 2 is a side the view of the container of FIG. 1.
Figure 3:
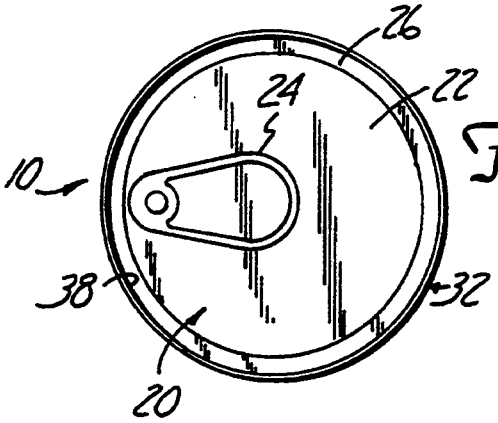
FIG. 3 is a top the view of the container of FIG. 1.
Figure 4:
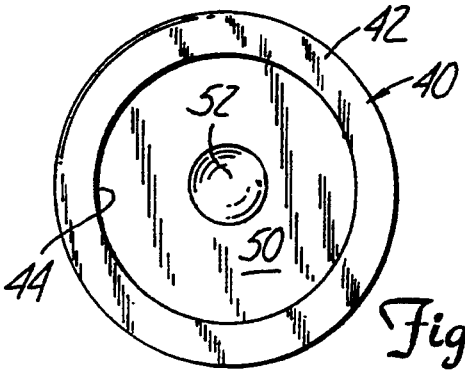
FIG. 4 is a bottom view of the container of FIG. 1.
Figure 5:
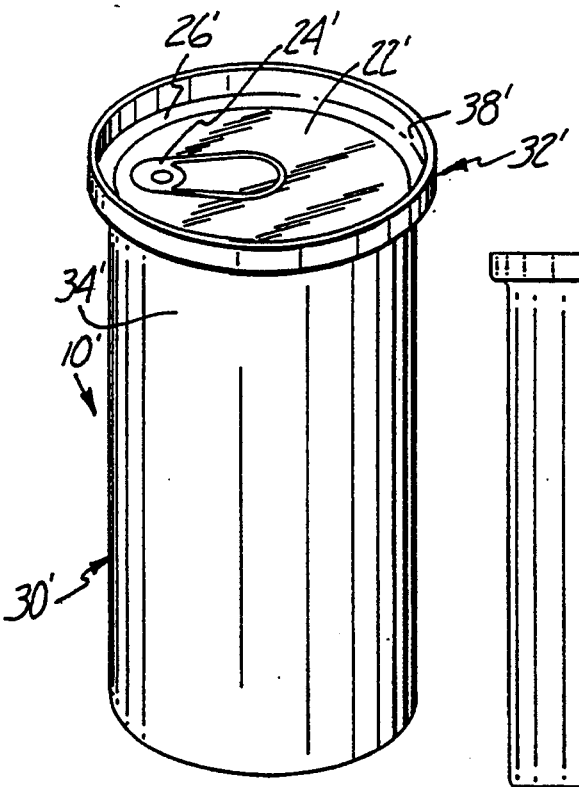
FIG. 5 is a perspective view of a container according to an alternative embodiment of the present invention.
Figure 6:
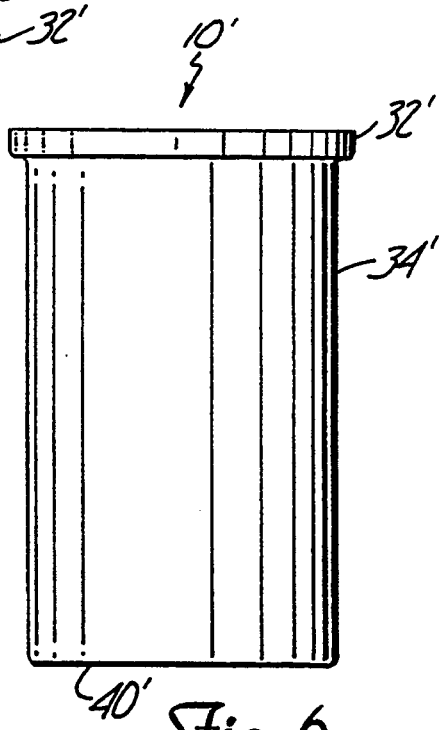
FIG. 6 is a side view of the container of FIG. 5.
Figure 7:
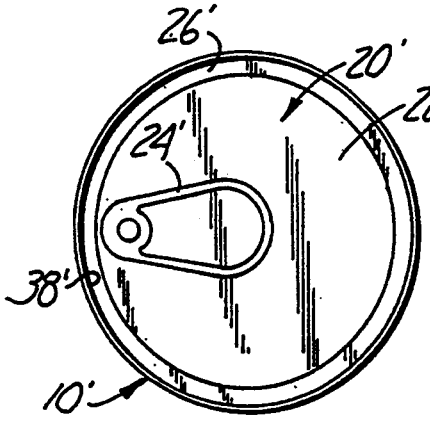
FIG. 7 is a top view of the container of FIG. 5.
Figure 8:
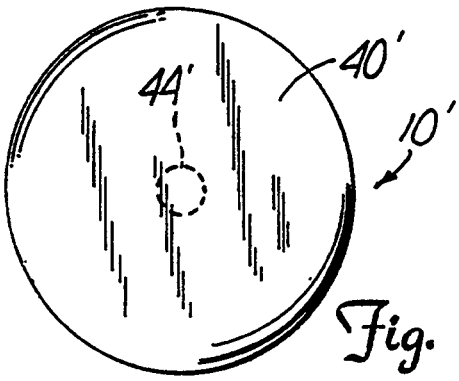
FIG. 8 is a bottom view of the container of FIG. 5.

FIGS. 1–4 and 9–9B depict a first embodiment of a container 10 of the instant invention. Generally, the container comprises a lid 20, a shell 30 and an insert in the form of a piston plate 50 for removing goods within the container. Although any suitable lid may be used, such as a standard screw-on style lid, a lid such as that shown in FIG. 1 is preferred. The lid 20 may comprise a generally planar cap 22 and a manually graspable tab 24 affixed to the cap. The shape of the cap will depend upon the shape of the shell 30; in the embodiment shown wherein the shell is generally tubular in shape, the cap is generally circular and is sized to sealingly engage an upper rim 32 of the shell. The cap 22 is desirably formed of a recyclable, malleable material such as aluminum, steel or plastic. Any known means of sealing the cap 22 to the shell 30 may be used, and the means chosen may depend on the materials being used for the shell and the lid 20. For instance, if a plastic material is used, the lid and shell may be bonded to one another by means of heat sealing, "spin welding" or by means of a suitable adhesive.

Figure 13:
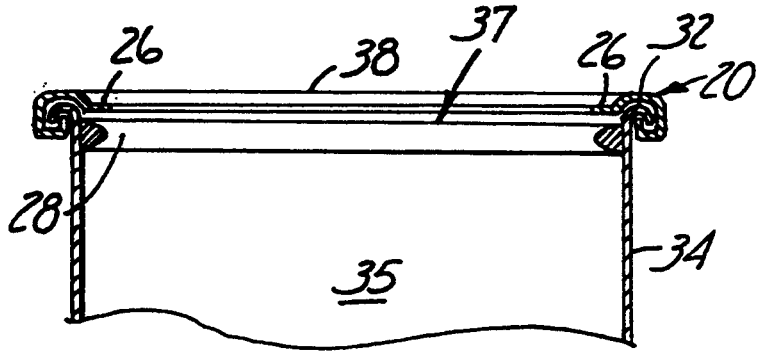
FIG. 13 is a side cross-sectional view of a lid and a top portion of a shell of an alternative embodiment of a container of the invention.
Figure 14:
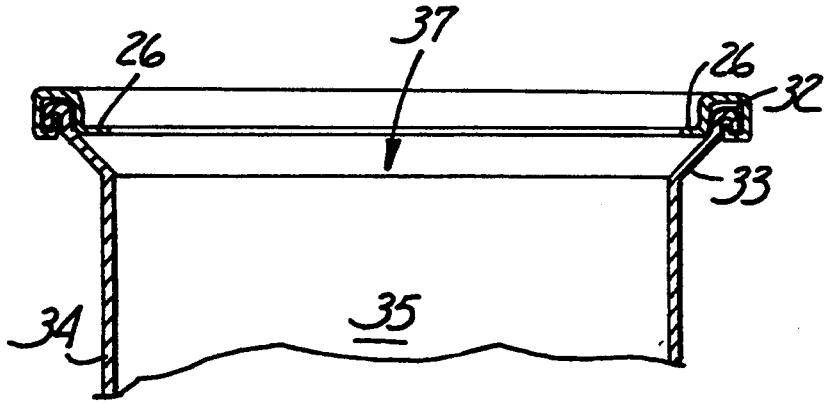
FIG. 14 is a side cross-sectional view of a lid and a top portion of a shell of another alternative embodiment of a container of the invention.

The tab 24 may also be formed of aluminum and be attached to the cap adjacent the edge thereof. By lifting a portion of the tab disposed away from the edge of the cap generally upwardly, the tab will urge downwardly against the cap adjacent its edge. This downward force should be sufficient to break the sealing engagement between the cap 22 and the upper rim 32 of the shell adjacent the tab, permitting the lid 20 to be removed from the shell to define an upper opening 37. The cap 22 may be attached directly to the rim 32 with the lid being scored along this attachment to permit easy removal of the cap from the shell. In a preferred embodiment, though, the cap is detachably connected to an integrally formed annular ring 26 of the lid and the outer periphery of this ring is mechanically affixed to the upper rim 32 of the shell by known means, such as by crimping as shown in FIGS. 13 and 14. Such lids are widely used in the art, e.g. in metal canisters for bulk materials such as nuts and the like, and need not be discussed in any greater detail here.

The shell 30 of the container 10 includes a sidewall or sidewalls 34, a bottom 40 and an upper rim 32. The shell, together with the lid 20 and piston 50 (described below), generally defines an interior cavity 35 of the container. Any desired product may be placed in the interior cavity during use, but the present container is best suited for expandable, non-flowable materials, i.e. expandable solid, non-bulk materials. As explained more fully below, the container is particularly suitable for storage of refrigeratable bread doughs and the like.

The sidewall or sidewalls 34 may be of any suitable shape for defining a desired interior cavity. The sidewalls preferably are relatively smooth or "straight-walled", i.e., they do not define an irregular interior cavity. As described below, this permits the piston plate 50 to be used to urge the contents of the container out of the top opening without encountering any obstruction. In a preferred embodiment, a generally tubular sidewall 34 is employed, thereby defining a generally cylindrical interior cavity 35. The inner diameter and length of the sidewall 34 should be selected to provide an interior cavity of a sufficient size to receive the product to be contained therein. Obviously, these dimensions may be varied to provide differently sized cavities to accommodate different quantifies of a product, such as in a line of refrigerated dough products.

The configuration of the upper rim 32 of the shell may be varied as desired. It is important, though, that the rim is shaped to permit the lid 20 to be readily detached from the shell. The shape and size of the upper rim are advantageously dictated by the shape and size of the sidewall or sidewalls 34 such that the upper rim defines a top opening 37 of the shell of about the same dimension as the interior dimension of the sidewalls. If the ring 26 of the lid or the upper rim 32 of the shell extends inwardly of the sidewalls too far, the top opening will be too small and the ring or the rim will interfere with the easy removal of the contents of the container 10 and tend to damage the product during removal. If so desired, the rim 32 or the ring 26 may include a peripheral upstanding flange 38, as shown, to protect the lid 20 and the rim 32 from inadvertent damage during handling; such a peripheral flange is a natural result of certain container forming techniques known in the art, such as wherein the lid 20 is crimped to the upper rim 32 of the shell.

If so desired, the lid 20 and upper rim 32 of the invention may be shaped differently from the lid and upper rim of FIGS. 1–12 in order to minimize damage to the product by the ring 26 of the lid or the upper rim 32 of the shell. FIGS. 13 and 14 depict two possible configurations for minimizing damage to the product. In FIG. 13, the upper rim 32 of the shell is mechanically affixed to the annular ring 26 of the lid 20 by crimping their outward peripheral edges together. An inwardly projecting annular bead 28 may be positioned immediately adjacent the annular ring 26 of the lid and be attached to the sidewall 34 of the shell. Instead, the bead 28 may be formed integrally with the sidewall 34 by indenting an annular portion of the sidewall to define the bead. If the sidewall 34 is generally cylindrical, as shown, the bead 28 preferably extends generally radially inwardly and presents a relatively gradual transition from the inner diameter of the sidewall 34 to the smaller diameter of the upper opening 37 of the container, which is bounded by the annular ring 26 of the lid.

As a product is urged upwardly through this upper opening 37 for removal from the container, as explained more fully below, it will first contact this bead 28. It will be relatively gradually compressed about its edges so that it will be generally no larger than the upper opening 37, reducing any undesirable frictional contact with the ring 26. This construction minimizes shear adjacent the periphery of the product, thereby limiting any damage to the product that such shear may cause.

FIG. 14 depicts an alternative embodiment of an upper rim 32 of the shell and a ring 26 of the lid. In this embodiment, the upper rim of the shell includes a tapered, flared-out portion 33 which extends generally radially outwardly in an upward direction. The annular ring 26 of the lid may be attached to the upper rim 32 adjacent the top of this flared-out portion, such as by crimping as shown. The flared-out portion 33 of the sidewall 34 should extend radially outwardly at least as far as the annular ring 26 extends radially inwardly from the upper rim 32, as shown in FIG. 14. In the embodiment shown in FIG. 14, the inner edge of the ring 26 defines an opening 37 of the container having a diameter substantially equal to the inner diameter of the sidewall 34. This disposes the ring 26 away from the opening and the product will therefore encounter less frictional resistance and less shear when contacting the ring 26 during removal, thereby reducing damage to the product during removal.

In the present embodiment, the bottom 40 of the shell desirably does not seal the entire bottom of the sidewalls. Instead, the bottom desirably comprises an inwardly extending flange 42 which defines an access port 44 through the bottom 40. In the depicted embodiment wherein the sidewall is generally tubular, the flange 42 desirably extends radially inwardly of the sidewall 34 a uniform distance so that the access port 44 is centered about the axis of the sidewall 34. The size of this access port may be varied as desired, but should be large enough to permit a utensil suitable for moving the piston 50 to be passed therethrough, as described below.

It should be understood, though, that a secondary seal may be employed to cover the port during storage in order to maintain sanitary conditions within the container. Such a seal may, for example, comprise a layer of a metal foil attached to the bottom of the container. Such a seal should be readily removable to permit a consumer to access the piston 50 through the port 44. In a preferred embodiment of the invention, this seal is not a weight-bearing structural element of the container—the piston 50 described below serves to effectively seal the container and retain the internal pressure of the can—but rather serves as a barrier to contamination and the like.

A container 10 of the invention also includes a piston 50 for removing product from the interior cavity 35. This piston may be made from a different material than the rest of the container. In a preferred embodiment, however, the piston is formed from the slug of material left when the access port 44 is cut through the bottom of the can during manufacture of the container. The slug may then be shaped and sized to provide the desired piston by known forming techniques.

The piston's maximum dimension should not be significantly larger than that of the interior cavity 35. For instance, if the sidewall is generally cylindrical as shown in the drawings, the piston's diameter should not be much larger than the inner diameter of the sidewall. This will ensure that the piston may be urged axially upwardly within the shell without encountering undue frictional resistance with the sidewall 34 of the shell. The piston should be larger than the access port 44, though, so the piston cannot inadvertently be removed from the container through the access port, permitting the contents within the container to become contaminated, and so that the piston will sealingly seat against the end of the inwardly extending flange 42 of the shell's bottom. The piston 50 and the flange 42 therefore together define a bottom for the container.

In a preferred embodiment, the piston is at most only slightly smaller than the inner dimensions of the shell or may actually engage and urge against the inner surface of the sidewall. This will prevent the product from seeping between the piston and the shell when the piston is urged upwardly to remove the product, as described below. This will also help ensure that the piston is not inadvertently turned at an angle to the axis of the shell during this removal process, thereby damaging the product. In the embodiment shown in FIG. 9, this means that the piston will also be larger than the access port 44 or the opening 37 in the lid of the container, preventing the piston from being inadvertently removed from the shell.

Figure 9:
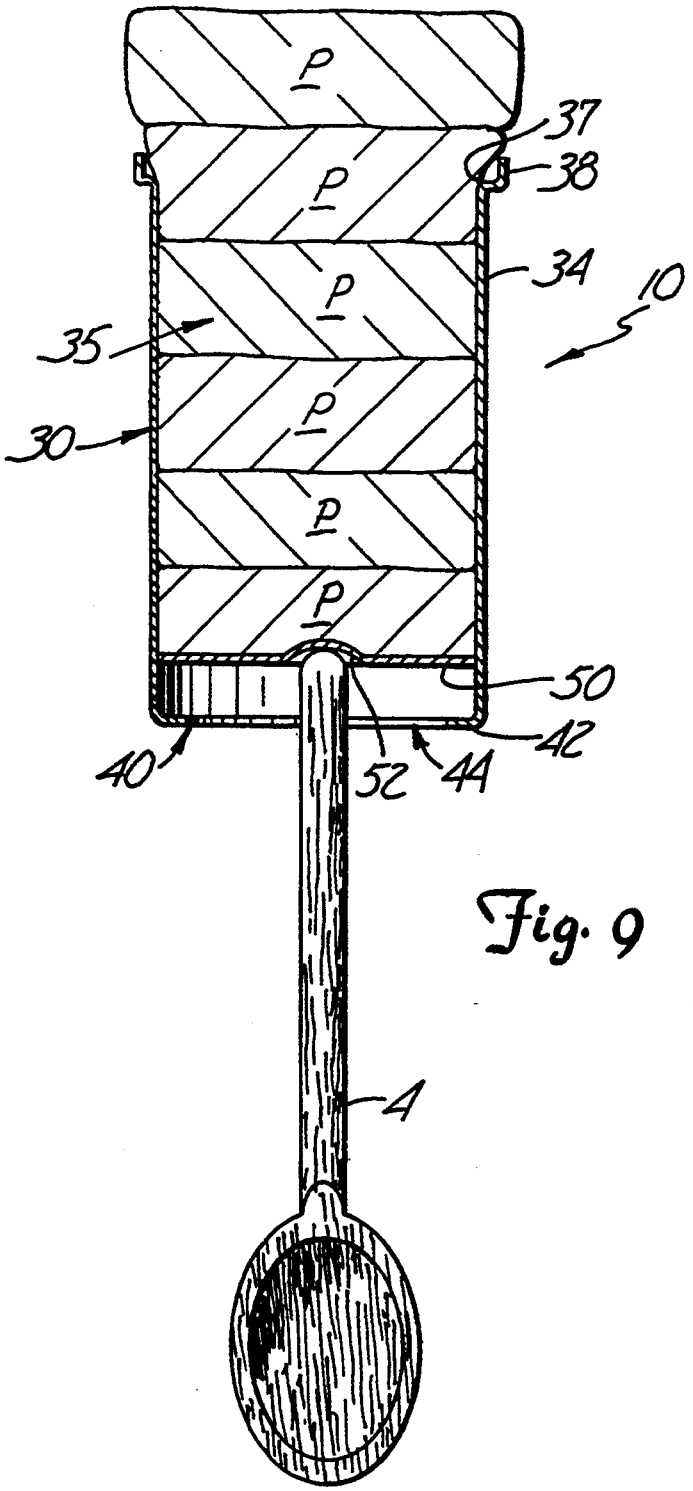
FIG. 9 is a schematic, side cross-sectional view depicting removal of a product from the container of FIG. 1.
Figure 9A:
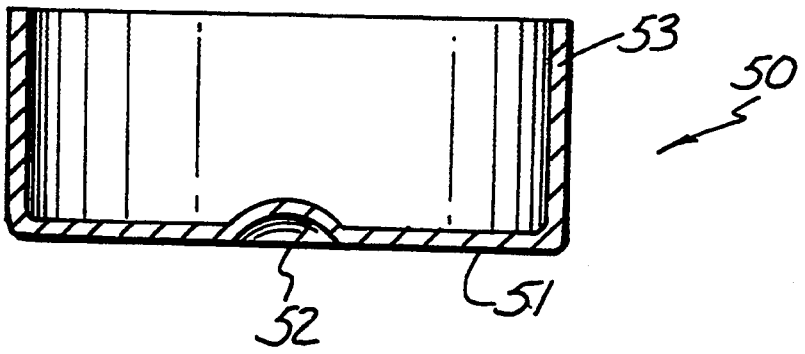
FIG. 9A is a side cross-sectional view of an alternative embodiment of a piston for use in the container of FIG. 1.
Figure 9B:
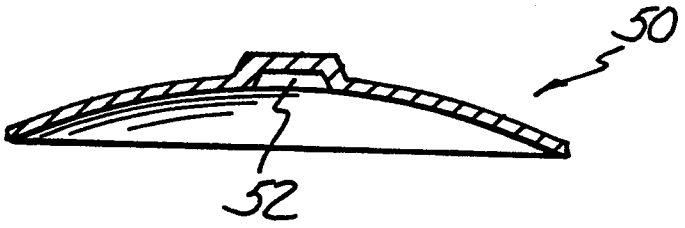
FIG. 9B is a side cross-sectional view of another alternative embodiment of a piston for use in the container of FIG. 1.
Figure 10:
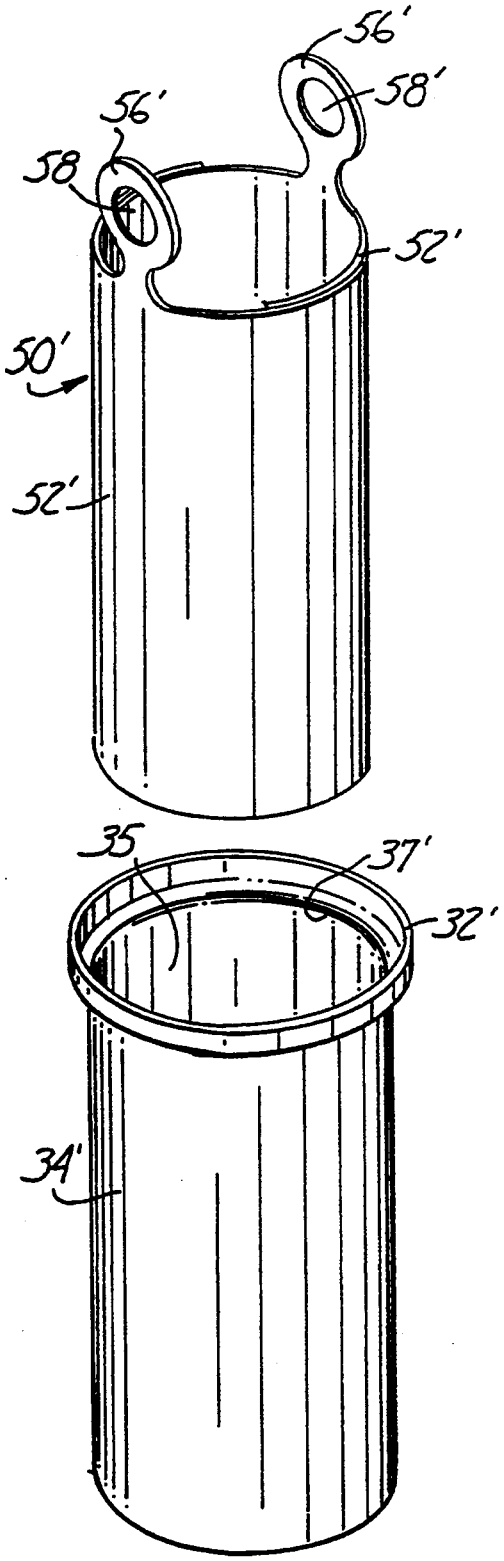
FIG. 10 is a partial exploded, perspective view of the container of FIG. 5.

The piston 50 may be of any desired shape. For instance, it may be generally flat and planar as shown in FIG. 9. Alternatively, it may be generally arcuately or dome-shaped and have a concave surface which faces downwardly as shown in FIG. 9B. As explained below, when it is desired to remove a product from the container one may use a utensil to urge the piston generally axially upwardly within the shell 30. The generally downwardly concave piston shown in FIG. 9B tends to direct the point of contact between this utensil and the piston toward the center of the piston, which desirably substantially coincides with the axis of the shell. By so positioning the utensil with respect to the piston, the urging force acting against the piston will tend to lie generally along the axis of the shell. This will, in turn, reduce the likelihood that the piston will be inadvertently turned as it is forced upwardly within the shell, which could damage the product.

As shown in FIG. 9 and 9B, the piston 50 desirably includes a recess 52, which may be substantially centered on the piston. The recess should be sized and shaped to receive an end portion of a wide range of utensils. For instance, if the container of the invention is adapted for packaging and storing a food product, the recess may be sized and shaped to receive a variety of kitchen utensils, such as an end of a handle of a spoon, as shown in FIG. 9. The recess 52 may, for instance, be generally arcuately shaped and downwardly concave, as shown in FIG. 9A, or may have a generally tapered interior presenting a generally downwardly concave recess, as shown in FIG. 9B. This recess will further serve to ensure that the utensil is generally centered on the piston so that the urging force against the piston will act generally along the axis of the shell to avoid inadvertent tipping or turning of the piston when removing the product.

FIG. 9A illustrates yet another embodiment of a piston 50 of the invention. As shown in that Figure, the piston 50 may comprise a generally circular, planar member 51 with a downwardly concave recess 52 formed adjacent the center thereof. A generally cylindrical skirt 53 may extend upwardly from the periphery of the planar member and be oriented generally perpendicular thereto. The skirt is desirably adapted to closely engage the inner surface of the sidewall 34 of the shell and to receive a portion of the contents of the container. Such a skirt will tend to engage the sidewalls of the shell, making it more difficult to inadvertently turn the piston with respect to the axis of the shell while urging it upwardly to remove the product.

The skirt also helps achieve an effective seal between the piston 50 and the shell —not only does it increase the surface area of the piston in contact with the shell. The product within the container can engage the skirt and serve to further seal the bottom of the container. For instance, in the case of an expandable food product such as a refrigeratable dough, the product will tend to urge outwardly against the skirt, forcing the skirt into engagement with the sidewall. Such a product may also tend to urge against the interface between the upper edge of the skirt and the sidewall, limiting the ability of gas within the container to escape the cavity 35 between these elements.

In order to effectively seal the container from the exterior environment, it may be necessary to provide a sealing material either adjacent the periphery of the piston on its bottom side or along the upper side of the flange 42. In one preferred embodiment wherein both the shell 30 and the piston 50 are formed of a metal such as aluminum, it has been found that the metal-to-metal engagement between these two elements may not be sufficient to seal the interior of the container from the environment. A bead formed of bees wax or a soft plastic material positioned about the upper surface of the flange 42, though, serves to effectively seal the piston against the flange in circumstances where the contents within the container are under pressure and urge the piston against the flange. Alternatively, the piston may be formed of a different material from that of the shell to achieve a better seal. For instance, the piston may be formed of a plastic material while the shell is formed of a metal.

A container of the present embodiment is particularly well-suited for use with an expandable food product. In packaging such a product, the product may be placed in the shell 30 with the piston 50 disposed between the product and the bottom 40 of the shell. The lid 20 may then be attached to the upper rim 32 of the shell 30 to seal the product within the container and the product may be expanded. It is particularly preferred that a self-expanding product, such as refrigeratable dough, be used. As noted above, heating dough causes the dough to rise due to the presence of leavening agents in the dough, i.e., the dough is self-expanding. As the dough expands within the cavity, it urges the piston downwardly in FIG. 1 and flushes the cavity of any air contained therein. The dough will urge the piston 50 against the flange 42 of the shell and effectively seal the container from the outside environment. In accordance with current dough manufacturing standards, the dough may be leavened further such that a pressure of 15–20 psi is attained within the container. This packaged, pressurized dough product may then be stored and shipped at refrigeration temperatures until it is sold to the ultimate consumer.

In some instances, such a simple flushing of air from the container may not suffice to adequately remove oxygen from the container. Any of a wide variety of currently known methods of removing unwanted headspace and air from dough containers may be used in such circumstances. For example, in current spirally wound composite cans, the seal between the composite sidewall of the can and the metal cap placed on the sidewall may be slightly "leaky", i.e. it may permit excess air within the container to be urged out of the container under pressure during proofing. If a container of the invention employs currently available composite, spirally wound materials in the construction of its sidewalls, such a "leaky" seam may be used. It is to be understood that the present invention still has major advantages over current container designs even if composite materials are used; such advantages include the relative ease and predictability associated with opening and removing the contents of the present containers.

When the consumer desires to bake the dough contained in the container 10, he or she will first remove the lid 20 by lifting up on the tab 24, as outlined above. Since the dough is under pressure, it will tend to expand somewhat and extend upwardly through the top opening 37 of the shell. The consumer may then push upwardly against the piston 50 through the access port 44.

It would be advantageous for the consumer to utilize a utensil, such as the handle of a spoon or the like, which may be passed through the access port 44 to slide the piston 50 generally axially upwardly within the shell. The piston will therefore force all of the product within the interior cavity 35 of the container outwardly through the top opening 37. The consumer may then bake the dough or otherwise use the contents of the container.

A container of this embodiment of the invention is significantly easier for a consumer to use than the standard spirally wound containers currently used in commercial refrigeratable dough manufacturing. As explained above, spirally wound composite cans tend to have a startling popping noise associated with rupture of the container as the outer layer of the side wall is removed. This startling popping noise is substantially eliminated in the present invention. When the cap 22 of the lid 20 is removed, the internal pressure of the container is released. This makes the venting sound of this pressure release very predictable and consumers opening a container of the invention therefore will not be startled by this sound.

Furthermore, current spirally wound cans can present difficulties for removing the products stored therein due to the generally helical bias of the layers of sheet material forming the side wall of such containers. Removing a product from a container of the present invention, though, is quite simple. Once the cap 24 is removed from the container, a consumer may simply urge generally upwardly against the piston 50 to force the product out of the upper opening 37 of the container, as explained above. This permits a consumer to quickly and easily remove all of the contents of a container of the invention with a single motion.

A second, alternative embodiment of the invention is shown in FIGS. 5–8 and 10–12, wherein elements corresponding to similar elements in FIGS. 1–4 and 9–9B bear like numerals followed by a prime. This container 10' includes a lid 20', a shell 30' and an insert 50' for removing product within the container. The embodiment shown in FIGS. 1–4 and 9–9B utilizes a piston 50 as an insert for removing product from the container while the present embodiment instead employs a liner 50' as such an insert.

The lid 20' in the embodiment of FIGS. 5–8 may be essentially identical to the lid 20 described above in connection with FIGS. 1–4 and 9–9B. Similarly, the upper rim 32' and the sidewall or sidewalls 34' of the shell 30' may be substantially the same as the upper rim 32 and sidewall 34 of shell 30 shown in FIGS. 1–4 and 9–9B and described above.

The bottom 40 of the previous embodiment comprises an inwardly extending flange 42 which defines an access port 44 through the bottom for contacting the piston 50. In the present embodiment, though, the bottom 40' desirably does not include such an access port, but rather is generally planar and extends across the entire bottom of the shell, as shown. Hence, the lid 20' and the shell 30' together provide a sealed interior cavity which is isolated from the exterior environment.

If so desired, a vent (shown in phantom at 44' in FIG. 8) may be provided in the bottom 40'. This vent should remain sealed during normal use of the container, being opened only for removal of the product. The seal on this vent may be achieved in any suitable manner known in the art, such as by means of a piece of foil applied with an adhesive or by scoring a portion of a solid bottom to permit it to be broken away by the consumer to define the vent 44'. It is important to note, though, that the contents of the present container may be under pressure, such as when the container is used for refrigeratable bread dough. Accordingly, it is important that the means of sealing the vent be suitably durable to withstand this pressure.

When a consumer opens the container and desires to remove the contents by withdrawing the liner 50', as described below, the seal on the vent should be broken. This will permit air to enter the bottom of the container below the product, alleviating any vacuum that may otherwise form beneath the product as it is withdrawn. This not only makes removal easier, it also minimizes damage to the product which could occur by drawing the lower portion of the contents downwardly against the stirrup 54'.

The liner 50' of the invention is adapted to line substantially the entire inner surface of the sidewall 34'. In the embodiments depicted wherein the sidewall is generally tubular in shape, the liner may take the form of a similar tubular segment sized to line the circumference of the sidewall.

In the embodiment shown in FIGS. 5–8 and 10–12, the liner preferably comprises a pair of opposed liner segments 52' adapted to line the sidewalls 34' of the shell. The liner segments desirably are substantially wider than one-half the internal peripherally of the sidewall 34' such that the liners will overlap one another along their longitudinal edges to effectively isolate the product from the sidewalls. This will prevent the product within the container from contacting, and perhaps sticking to, the sidewalls of the shell. In the embodiment shown, wherein the shell is generally tubular in shape, each liner segment may comprise an elongate, curved sheet of a suitable material. The curvature of this sheet should define an arc of more than 180° so that the longitudinal edges of the sheets of the respective liner segments overlap one another.

The liner 50′ also desirably includes a stirrup 54′ attached to each of the liner segments adjacent the bottom thereof. In a preferred embodiment, the stirrup is attached to each liner segment at approximately the middle of its width such that the stirrup extends between generally diametrically opposed portions of the respective liner segments and forms a diametrical chord across the generally circularly shaped bottom of the liner. This stirrup, as explained more fully below, is disposed beneath the product within the interior cavity 35′ of the shell so that withdrawing the liner from the shell will withdraw all the contents of the container through the opening 37′.

Each liner is also provided with a manually graspable flange 56′ which extends upwardly from the upper edge of each liner segment 52′. This flange may take any desired shape which is suitable for easy grasping by a consumer removing product from the container. In the embodiment shown, for instance, the flange is generally circular in shape with a generally circular eyelet 58′ being centered thereon. The eyelet is preferably sized to permit a consumer to insert a finger or a thumb therethrough such that the consumer may grasp both flanges with a finger and a thumb of a single hand.

Figure 15:
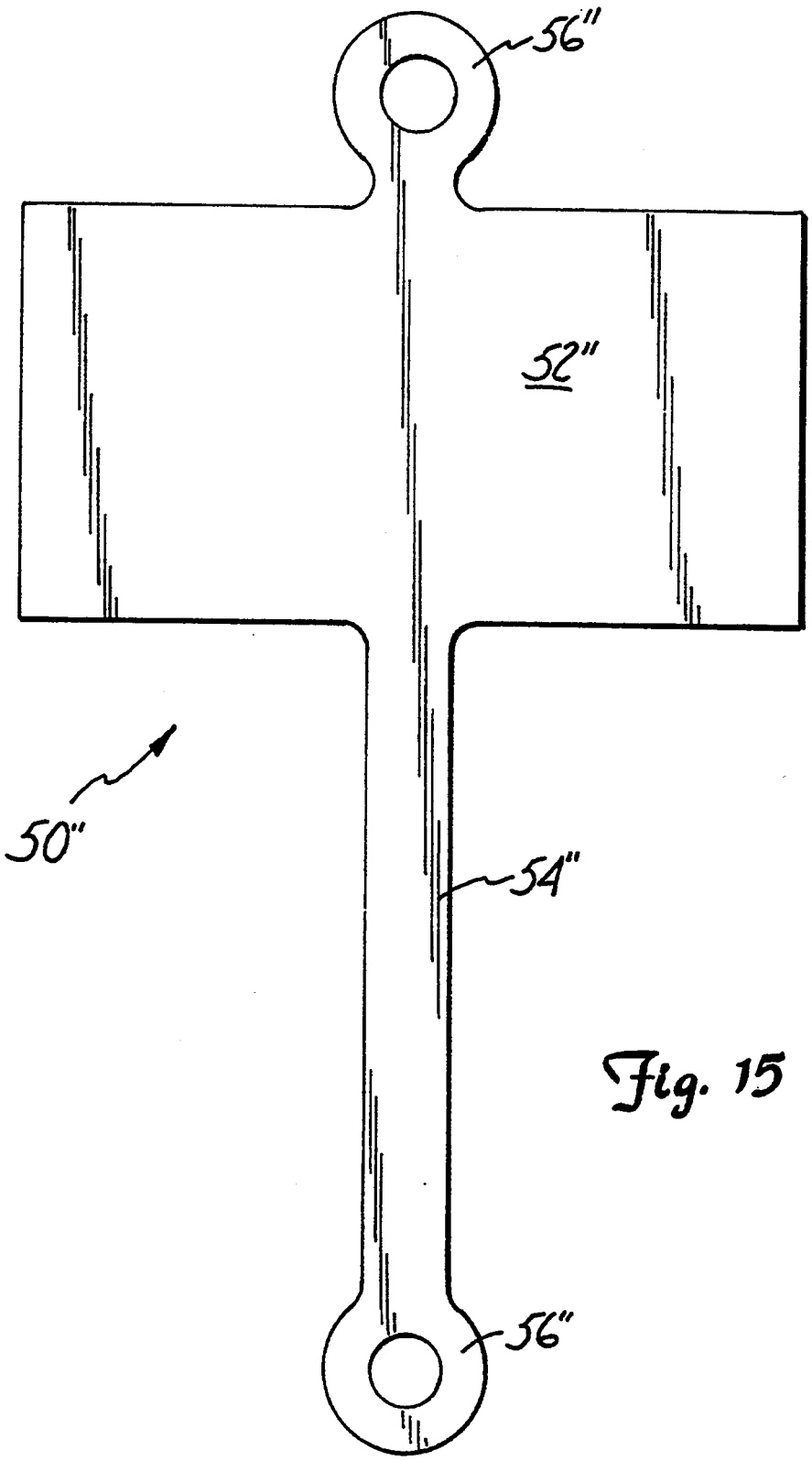
FIG. 15 is a top view of an alternative embodiment of a liner for use in the container of FIG. 5.

In the alternative embodiment of a liner 50″ shown in FIG. 15, there is only a single liner segment 52″ and this liner segment is sized to line substantially the entire inner surface of the sidewall rather than merely 180°, as in the previous embodiment. Whereas the stirrup 54′ of the previous embodiment desirably extends only from one liner segment to the other, as shown, in the embodiment of FIG. 15 includes a significantly longer stirrup 54″. It is particularly preferred that the stirrup is long enough to extend from the bottom of the liner segment 52″, beneath the product, and extend upwardly along the opposite side of the sidewall. It is also preferred that the end of the stirrup 54″ be provided with a manually graspable flange 56″; when the liner 50″ is in place within the container, the flange on the end of the stirrup is desirably generally diametrically opposite another flange 56″ provided on the upper edge of the liner segment.

The liner segment should be wider than the dimension of the sidewall's inner circumference so that the opposite edges of the segment will overlap one another when the liner is deployed in a container of the invention. This will not only limit physical contact between the product and the sidewall of the container, but it may also help maintain the stirrup 54″ in its proper position within the container by pinning a length of the stirrup between the overlapping portions of the liner segment.

The entire liner 50′ (or 50″) may be integrally formed of a single piece of a suitable sheet material. Alternatively, the flanges 56′ may be integrally formed with the liner segments 52′ while the stirrup 54′ is formed separately. Adjacent each of its ends, the stirrup may be attached to one of the liner segments to extend between and effectively connect the two liner segments.

In yet another embodiment (not shown), the two liner segments 52′ are formed separately from the flanges and the stirrup. The stirrup in this embodiment may comprise an elongate, strap-like element with the flanges 56′ being formed at either end thereof. The stirrup may then be attached adjacent each end to an upper portion of each liner segment to effectively position the flanges on each liner segment as shown. The elongate stirrup may then extend along the length of each liner segment and be attached to each liner segment adjacent a lower end thereof, disposing a central portion of the stirrup between the two liner segments.

The liner segment is desirably adapted to extend along substantially the entire height of the sidewalls 34′ of the shell 30′. The flanges are designed to permit them to be folded inwardly and downwardly, as shown, so that they do not extend beyond the upper rim 32′ of the shell; if these flanges extended beyond the upper rim, they would interfere with an effective seal between this rim and the lid 20′. As noted above in connection with the previous embodiment, when a container containing a refrigerated dough product is opened, the dough will tend to expand as the pressure is released. The flanges 56′ should therefore be designed to permit them to be readily bent upwardly into the position depicted in FIG. 10. If the flanges are difficult to urge outwardly and upwardly into the position shown, the flanges would impede the expansion of the dough, tending to damage pre-formed dough products such as biscuits. If the dough within the can is segmented into a series of discrete units, such as in the case of refrigerated biscuits, the consumer may simply remove the first or second unit from the top of the stack of units as these upper units will tend to extend upwardly above the upper rim 32′ of the shell. This will permit easy access to the flanges 56′ for removal of the rest of the product.

The consumer may then grasp each of the flanges, such as by passing a thumb and a finger of the same hand through the opposed eyelets 58′ in the flanges. The consumer may then pull upwardly on these flanges to remove the remaining contents of the container 10′ by withdrawing the liner 50′ generally axially upwardly with respect to the shell 30′. As noted above, the stirrup 54′ is disposed beneath the bottom of the contents of the container and the stirrup will therefore insure that all of the products will be lifted out of the shell with the liner. Once the liner has been removed from the shell, the two liner segments may be moved in opposite directions in a clamshell fashion, being pivoted generally outwardly about their inner connection, the stirrup. This permits ready access to all of the products which are removed with the liner.

Figure 11:
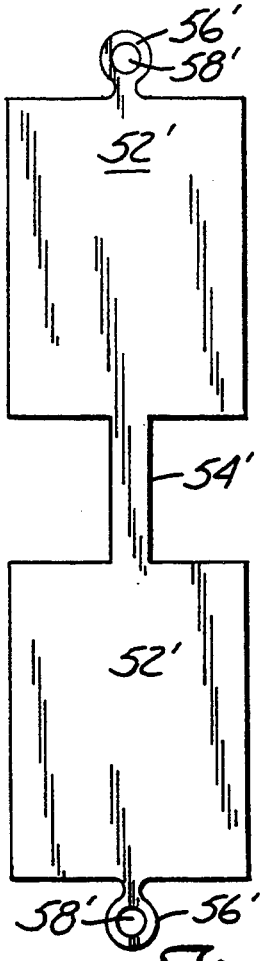
FIG. 11 is a top view of a liner for use in the container of FIG. 5.
Figure 12:
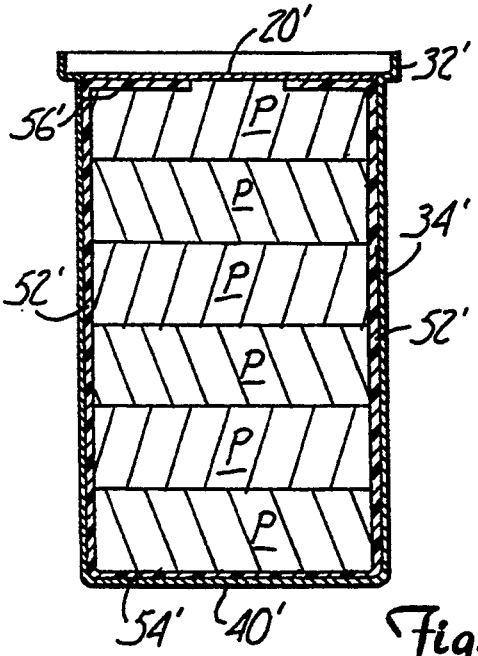
FIG. 12 is a schematic, cross-sectional view of the container of FIG. 5 showing a product therein.

As with the previous embodiment shown in FIGS. 1–4 and 9, and set forth above, a container such as that shown in FIGS. 5–8 and 10–12 is substantially easier to use than-a standard spirally wound container commonly used for refrigerated dough products and the like. As explained above in connection with the previous embodiment, the use of the cap 22′ makes the noise associated with opening the container predictable, eliminating the startling effect of rupturing standard spirally wound cans. Additionally, removal of the product is much easier because the consumer may simply grasp the flanges 56′ and withdraw all of the contents of the container along with the liner by withdrawing the liner from the shell. The liner may then be opened so that it lays generally flat, e.g., as depicted in FIG. 11, and the product will be readily accessible for use by the consumer.

In both the first and second embodiments, all of the components of the containers 10, 10′ may be readily formed of recyclable or recycled materials. Any recyclable or recycled material which will meet the necessary physical requirements for the container may be used. In packaging refrigerated dough products, aluminum has been found to work quite well. In the first embodiment shown in FIGS. 1–4 and 9–9B the lid 20, shell 30 and piston 50 may all be formed of aluminum according to known forming techniques. The piston 50 may be simply punched out of a stock of sheet material in a standard punch and die operation. If so desired, the recess 52 may be formed at the same time.

Aluminum not only meets the necessary physical requirements, but is one of the most widely recycled materials in America today. Suitable paints for directly marking the exterior of aluminum containers are known in the art, eliminating the need for a separate label. It may be desirable to use an organic liner on the interior of the can, such as is employed in the beverage industry, to isolate the product from direct contact with aluminum to preserve its flavor. This will present a can formed of a single material, which may be readily recycled with other aluminum beverage cans and the like. If so desired, the piston 50 may be formed of a different material, such as a thermoplastic material, and may be recycled separately from the lid 20 and the shell 30. It is desirable in such an instance that the piston be formed of a readily recyclable plastic that meets the strength and stiffness requirements for this application, such as plastics used in forming plastic containers for beverages and other liquids.

Similarly, the lid 20', shell 30' and liner 50' of the container 10' shown in FIGS. 5–8 and 10–12 may also be formed entirely of a single recyclable material such as aluminum. The material chosen for the liner and the cross-sectional area of the load-bearing portions of the liner should be capable of withstanding at least about 5–10 pounds of force in tension. If a significantly weaker material is used, the flanges will tend to break off from the liner segments, making it more difficult for the consumer to remove the liner from the container.

If an aluminum foil or the like is used, it has been found that it is better to use a textured foil rather than a standard, smooth foil. If a smooth foil is used, it is relatively difficult for air to pass between the exterior of the liner and the interior of the sidewalls 34' of the shell, making extraction of the liner relatively difficult; using a textured foil permits air to pass more readily between these two elements, facilitating liner removal. Alternatively, a sealable vent (44' in FIG. 8) may be provided in the bottom 40' to allow air to enter the shell beneath the product, as described above. However, aluminum foil tends to be relatively expensive for such a simple, disposable product. Hence, in a preferred embodiment, the liner 50' is integrally formed from a sheet of polyester film; such a film having a thickness of about 0.003" has been found to work quite well. This polyester film may be separated from the recyclable aluminum lid and shell and may even be separately recyclable in some areas.

While preferred embodiments of the present invention have been described, it should be understood that various changes, adaptations and modifications may be made therein without departing from the spirit of the invention and the scope of the appended claims. It is to be understood in particular that the container bottoms 40 and 40' shown in FIGS. 4 and 8 respectively may be separate pieces sealingly attached to said bottom sidewall of each container by whatever means appropriate.

We claim:

1. A method for processing an expandable food product comprising the steps of:

a. providing a container comprising a shell having a bottom having an access port formed therethrough, a sidewall and an upper rim; a removable cap attachable to the shell adjacent its upper rim; and a piston means slidably received within the shell, the shell, cap and piston means together defining a cavity of the container;

b. placing the expandable food product within the cavity prior to attaching the cap to the shell and then attaching the cap, the expandable food product being placed at a location disposed between the cap and the piston means;

c. increasing the pressure within the container to sealingly urge the piston means against an inner face of the bottom of the shell to substantially seal the cavity; and d. storing the product in a pressurized state within the cavity.

2. The method of claim 1 further comprising the steps of removing the cap from the shell to define an upper opening of the shell and urging the piston means toward the upper rim within the shell to urge the product out of the cavity through said upper opening.

3. The method of claim 2 wherein the piston means is urged by passing a utensil through the access port and urging the utensil generally upwardly against a lower surface of the piston means.

4. The method of claim 3 wherein the shell has an axis and the piston means is urged generally along the axis of the shell.

5. The method of claim 4 wherein the piston means includes a downwardly concave recess positioned generally along the axis of the shell, the utensil being urged against said recess in the piston means.

6. The method of claim 2 wherein the container includes a cover over the access port, further comprising the step of removing said cover to define the access port prior to urging said piston upwardly.

7. A method for processing an expandable food product comprising the steps of:

a. providing a container comprising a shell having a bottom having an access port formed therethrough, a sidewall and an upper rim; a removable cap attachable to the shell adjacent its upper rim; and a piston means slidably received within the shell, the shell, cap and piston means together defining a cavity of the container;

b. placing the expandable food product within the cavity prior to attaching the cap to the shell and then attaching the cap, the expandable food product being placed at a location disposed between the cap and the piston means;

c. permitting the expandable food product to expand and sea Jingly urge the piston means against an inner face of the bottom of the shell to substantially seal the cavity; and d. storing the product in an expanded state within the cavity.

8. The method of claim 7 further comprising the steps of removing the cap from the shell to define an upper opening of the shell and urging the piston means toward the upper rim within the shell to urge the product out of the cavity though the upper opening.

9. The method of claim 8, wherein the piston is urged by passing a utensil through the access port and urging the utensil generally upwardly against a lower surface of the piston means.

10. The method of claim 9, wherein the shell has an axis and the piston means is urged generally along the axis of the shell.

11. The method of claim 10, wherein the piston means includes a downwardly concave recess positioned generally along the axis of the shell, the utensil being urged against said recess in the piston means.

12. The method of claim 8, wherein the container includes a cover over the access port, further comprising the step of removing the cover to define the access port prior to urging the piston upwardly.

* * * * *